US008075324B2

(12) United States Patent
Yamaji et al.

(10) Patent No.: US 8,075,324 B2
(45) Date of Patent: Dec. 13, 2011

(54) CONNECTOR ASSEMBLY HAVING A DETECTION SWITCH WHICH IS CLOSED OR OPENED BY OPERATION OF A LOCKING MEMBER

(75) Inventors: Takahiro Yamaji, Tokyo (JP); Masahide Watanabe, Tokyo (JP); Takamitsu Nakajima, Tokyo (JP); Hiroki Kamata, Hirosaki (JP); Akira Kimura, Hirosaki (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 93 days.

(21) Appl. No.: 12/658,932

(22) Filed: Feb. 17, 2010

(65) Prior Publication Data

US 2010/0210130 A1 Aug. 19, 2010

(30) Foreign Application Priority Data

Feb. 19, 2009 (JP) ..... 2009-037246

(51) Int. Cl.
*H01R 29/00* (2006.01)

(52) U.S. Cl. ..... 439/188; 439/372; 439/911

(58) Field of Classification Search ..... 439/188, 439/489, 490, 911, 372; 200/51.09
See application file for complete search history.

(56) References Cited

U.S. PATENT DOCUMENTS 1,818,290 A * 8/1931 Wulle ..... 200/50.3
1,947,634 A * 2/1934 Anderson ..... 200/50.29
3,908,103 A * 9/1975 Gyurka ..... 200/50.28
4,345,122 A * 8/1982 Janniello ..... 200/50.29
4,774,399 A * 9/1988 Fujita et al. ..... 235/441
4,878,853 A * 11/1989 Yamade et al. ..... 439/144
5,035,644 A * 7/1991 Nakazato et al. ..... 439/372
5,077,722 A * 12/1991 Geist et al. ..... 720/657
5,127,848 A * 7/1992 Taguchi ..... 439/489
5,220,520 A * 6/1993 Kessoku ..... 361/679.31
5,311,397 A * 5/1994 Harshberger et al. .... 361/679.58
5,435,748 A * 7/1995 Abe ..... 439/489

(Continued)

FOREIGN PATENT DOCUMENTS

JP 03-050776 5/1991

(Continued)

OTHER PUBLICATIONS

Japanese Office Action dated Jan. 6, 2011 with English translation of same.

*Primary Examiner* — Neil Abrams
(74) *Attorney, Agent, or Firm* — Collard & Roe, P.C.

(57) ABSTRACT

A connector assembly includes a receptacle connector and a plug connector matable with the receptacle connector along a mating direction. The plug connector includes a lock activation portion movable between a lock position and an unlock position along an activation direction under a mating state. The receptacle connector includes a detection switch and a deformable lock operation member pivotably mounted to the plug connector that ensures movement of the lock activation portion in a separation direction when the lock activation portion is located at the unlock position under the mating state. The lock operation member has lock member ends that are received by holes of a receptacle shell to retain the plug connector and receptacle connector in the locked position and to effect closure of the detection switch. The detection switch is pressed by the lock activation portion to detect the lock activation portion is located at the lock position.

15 Claims, 14 Drawing Sheets

U.S. PATENT DOCUMENTS

| | | | | |
|---|---|---|---|---|
| 5,554,893 | A * | 9/1996 | Oku | 307/119 |
| 5,949,652 | A * | 9/1999 | McAnally et al. | 361/726 |
| 6,053,756 | A | 4/2000 | Flanigan et al. | |
| 6,830,478 | B1 * | 12/2004 | Ko | 439/579 |
| 6,948,958 | B1 | 9/2005 | Kikuchi et al. | |
| 7,431,617 | B2 * | 10/2008 | Yamaji | 439/607.17 |
| 7,722,387 | B2 * | 5/2010 | Yamaji et al. | 439/497 |
| 7,927,122 | B2 * | 4/2011 | Yamaji et al. | 439/342 |
| 2010/0210130 | A1 * | 8/2010 | Yamaji et al. | 439/352 |

FOREIGN PATENT DOCUMENTS

| | | |
|---|---|---|
| JP | 2002-514000 | 5/2002 |
| JP | 2005-267977 | 9/2005 |

* cited by examiner

CONNECTOR ASSEMBLY HAVING A DETECTION SWITCH WHICH IS CLOSED OR OPENED BY OPERATION OF A LOCKING MEMBER

CROSS REFERENCE TO RELATED APPLICATIONS:

Applicants claim priority under 35 U.S.C. §119 of Japanese Patent Application No. JP2009-037246 filed Feb. 19, 2009.

BACKGROUND OF THE INVENTION:

The present invention relates to a connector assembly having two connectors with a lock mechanism for locking a mating state of the two connectors.

For example, this type of connector assembly is disclosed in JP-A 2005-267977, the contents of which are incorporated herein by reference. JP-A 2005-267977 discloses a pair of connectors including a plug connector having an angular C-shaped pull bar and a substrate connector. Even if a force is applied to the plug connector so as to separate the plug connector from the substrate connector under the mated state of the plug connector with the substrate connector, tips of the pull bar are engaged with engagement portions of the substrate connector. Accordingly, the mating state of those connectors is maintained.

With the connector assembly disclosed in JP-A 2005-267977, a user has to visually examine whether the mating state has been locked. However, recent reduction of the size of connectors has made it extremely difficult to determine by visual inspection whether the mating state has been locked.

SUMMARY OF THE INVENTION:

It is therefore an object of the present invention to provide a connector assembly which can meet demands for reduction in size and allows a user to readily examine whether a mating state is locked.

One aspect of the present invention provides a connector assembly which comprises a first connector and a second connector matable with the first connector along a mating direction. The second connector includes a lock activation portion movable between a lock position and an unlock position along an activation direction perpendicular to the mating direction under a mating state of the first connector and the second connector. The first connector includes a lock operation portion configured to ensure movement of the lock activation portion in a separation direction opposite to the mating direction when the lock activation portion is located at the unlock position under the mating state and to prevent movement of the lock activation portion in the separation direction so as to lock the mating state together with the lock activation portion of the second connector when the lock activation portion is located at the lock position. The first connector also includes a detection switch configured to be pressed by the lock activation portion located at the lock position under the mating state for detecting that the lock activation portion is located at the lock position.

An appreciation of the objectives of the present invention and a more complete understanding of its structure may be had by studying the following description of the preferred embodiment and by referring to the accompanying drawings.

Figure 1:
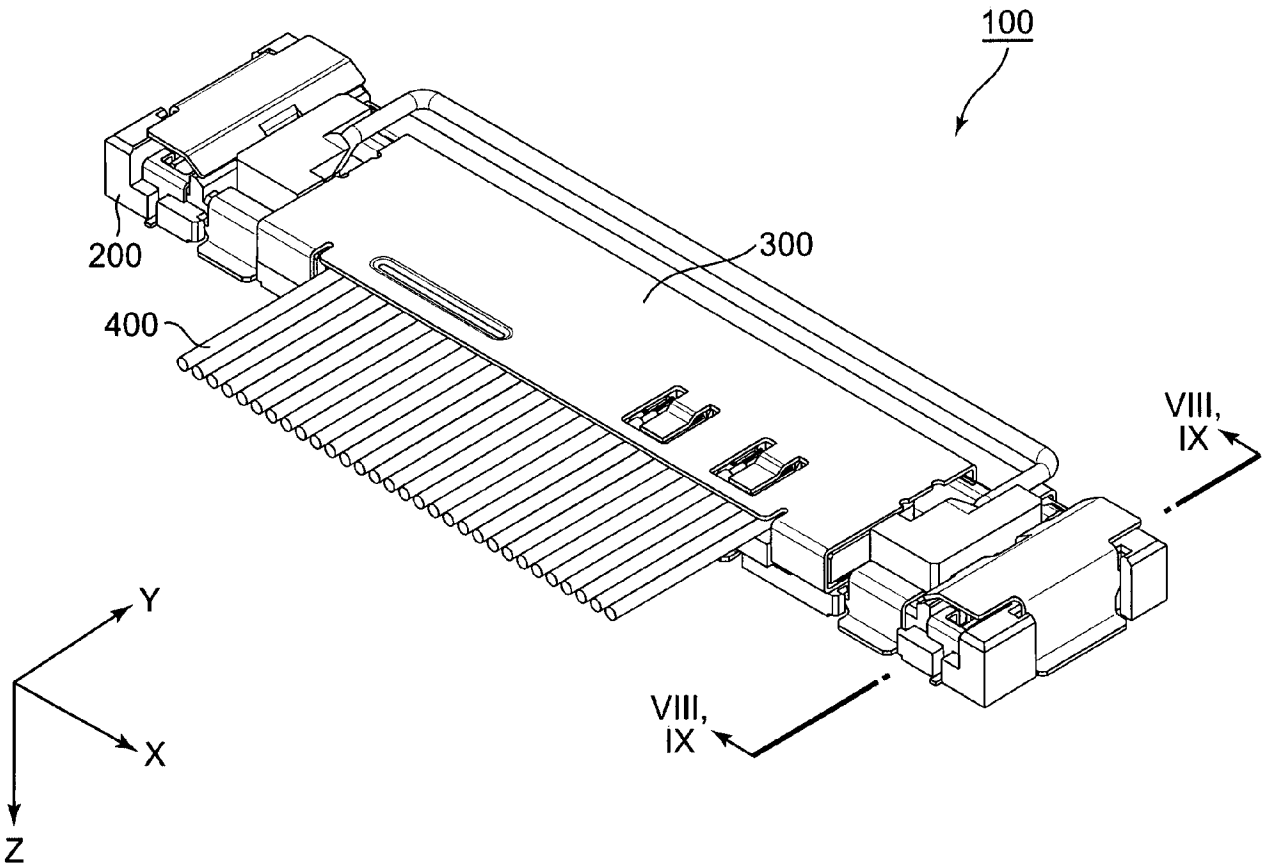
FIG. 1 is a perspective view showing a connector assembly including a plug connector and a receptacle connector according to an embodiment of the present invention, wherein the plug connector and the receptacle connector are under their mating state.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

Figure 2:
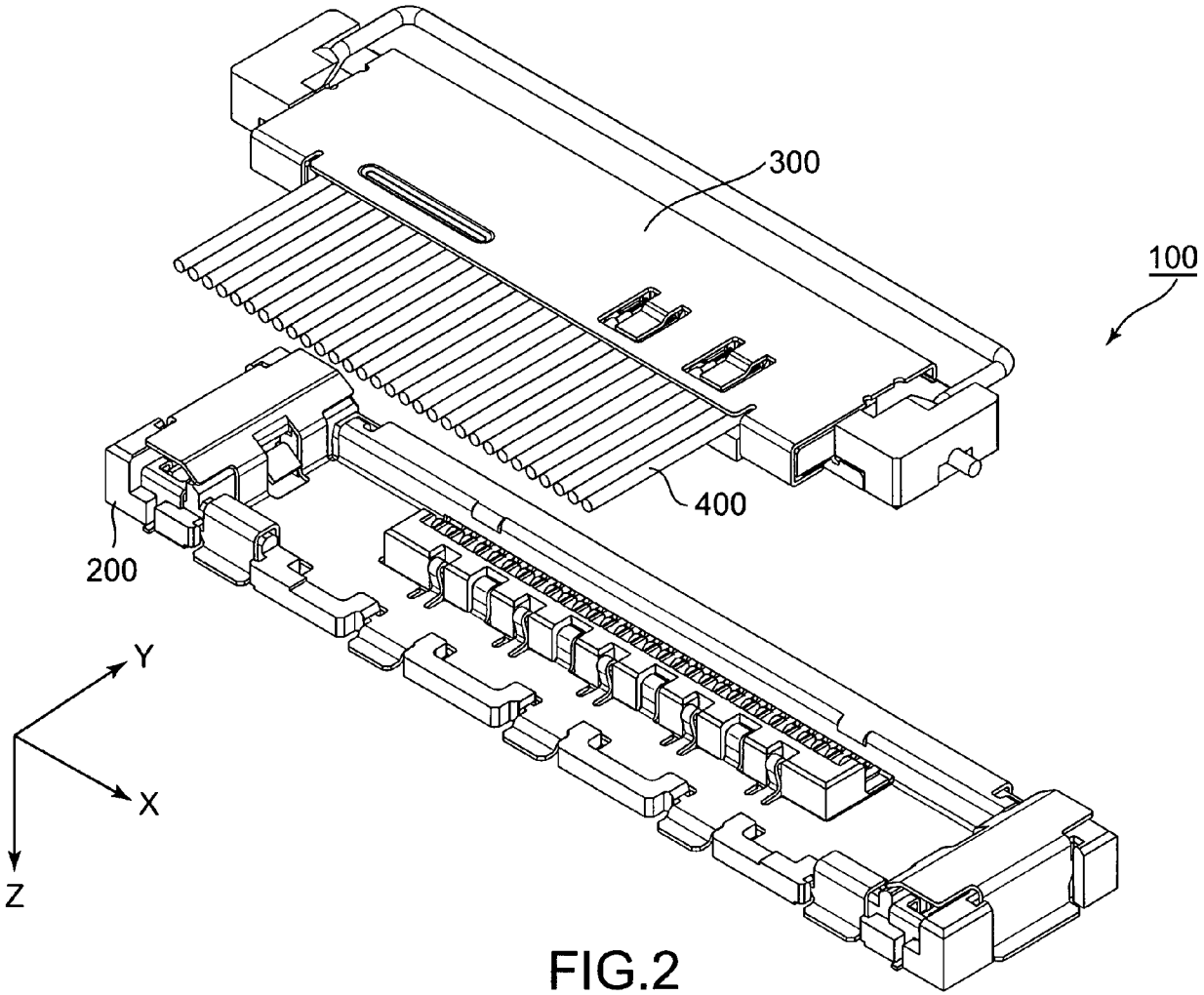
FIG. 2 is a perspective view showing the connector assembly of FIG. 1, wherein the plug connector is separated from the receptacle connector.

DESCRIPTION OF PREFERRED EMBODIMENTS:

As shown in FIGS. 1 and 2, a connector assembly 100 according to an embodiment of the present invention includes a receptacle connector (first connector) 200 mounted and fixed on a substrate (not shown) and a plug connector (second connector) 300 matable with the receptacle connector 200 along the Z-direction (mating direction). In this embodiment, cables 400 are connected to the plug connector 300.

Figure 3:
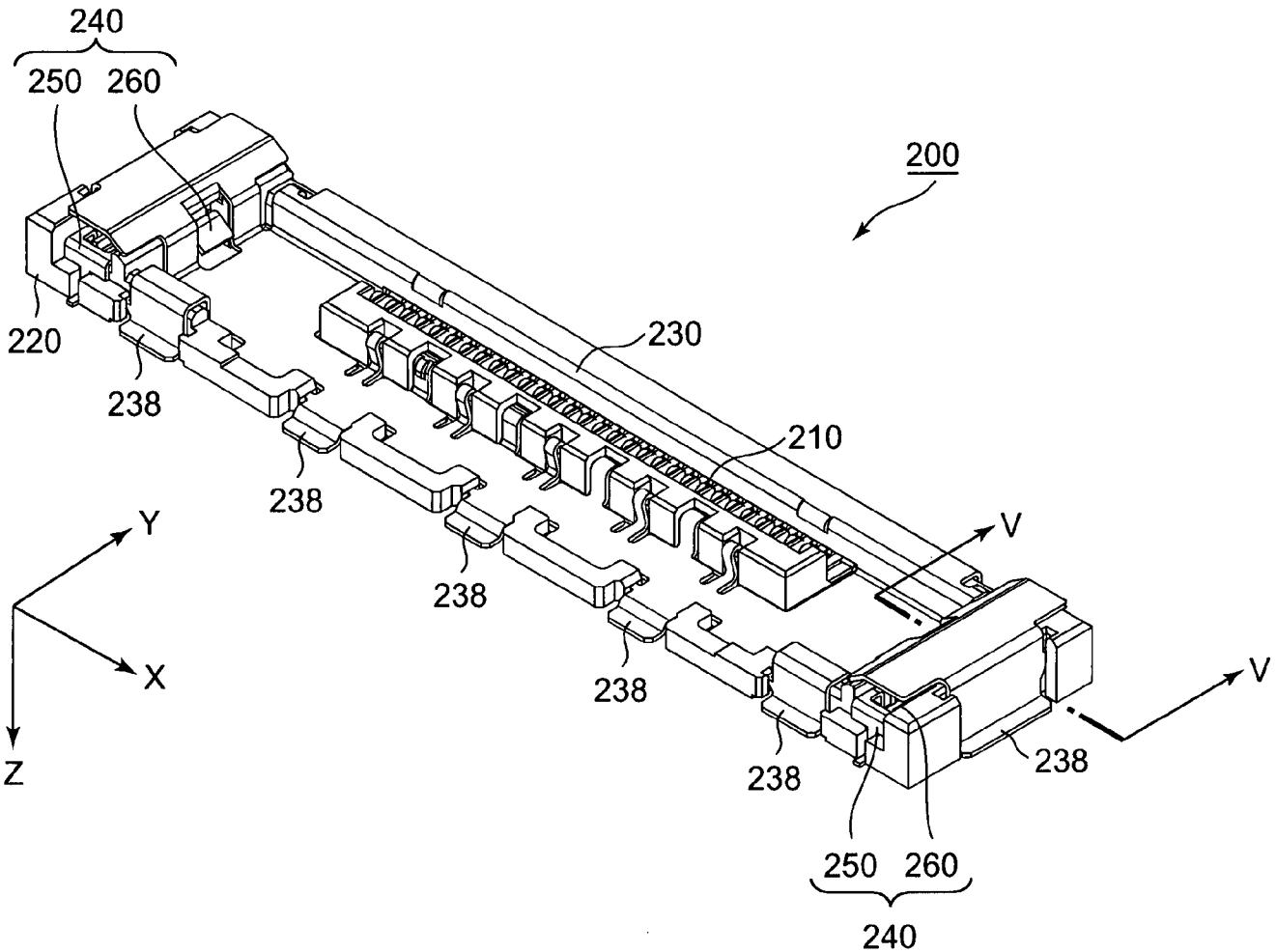
FIG. 3 is a perspective view showing the receptacle connector of FIG. 1.
Figure 4:
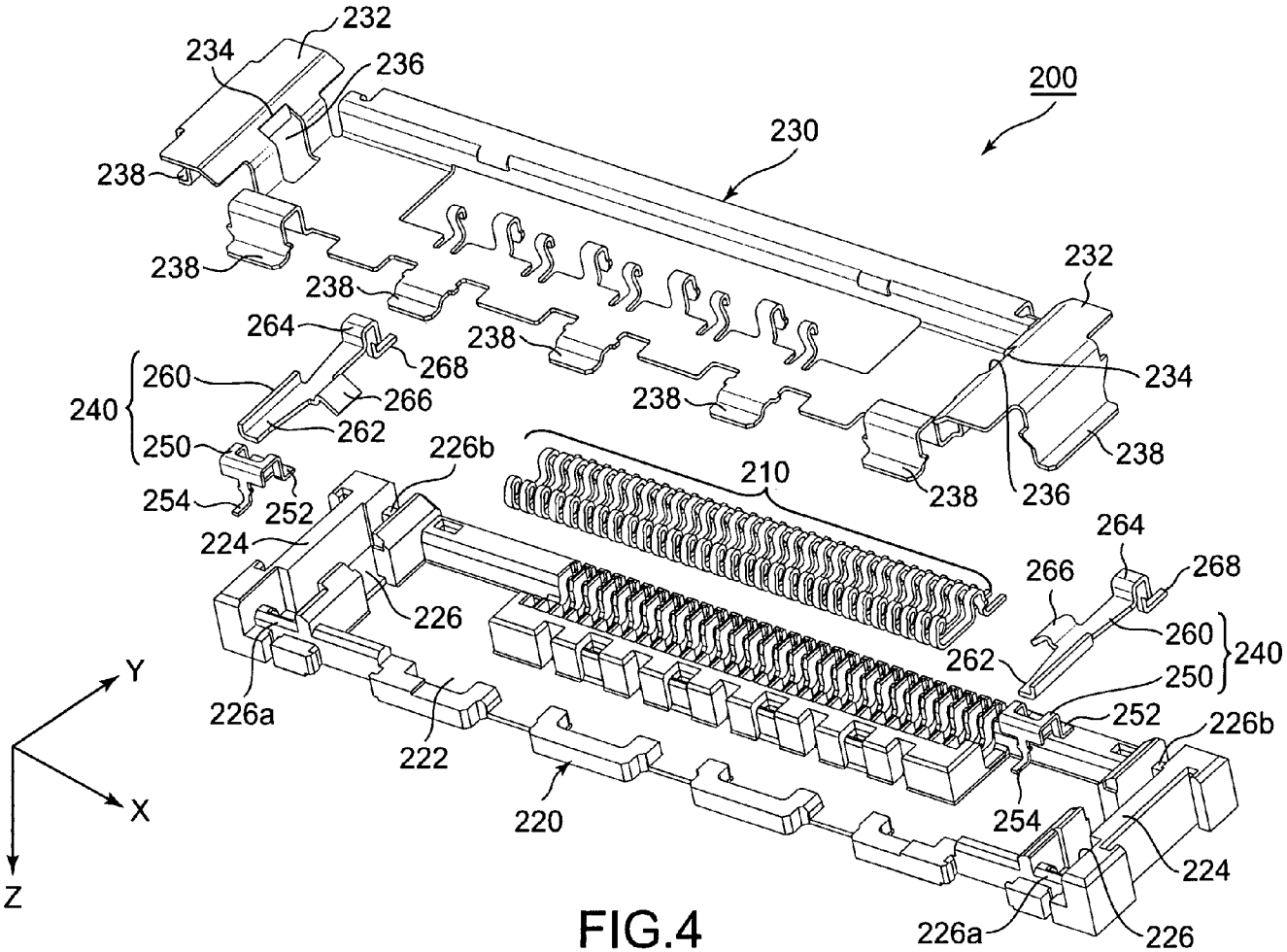
FIG. 4 is an exploded perspective view showing the receptacle connector of FIG. 3.
Figure 5:
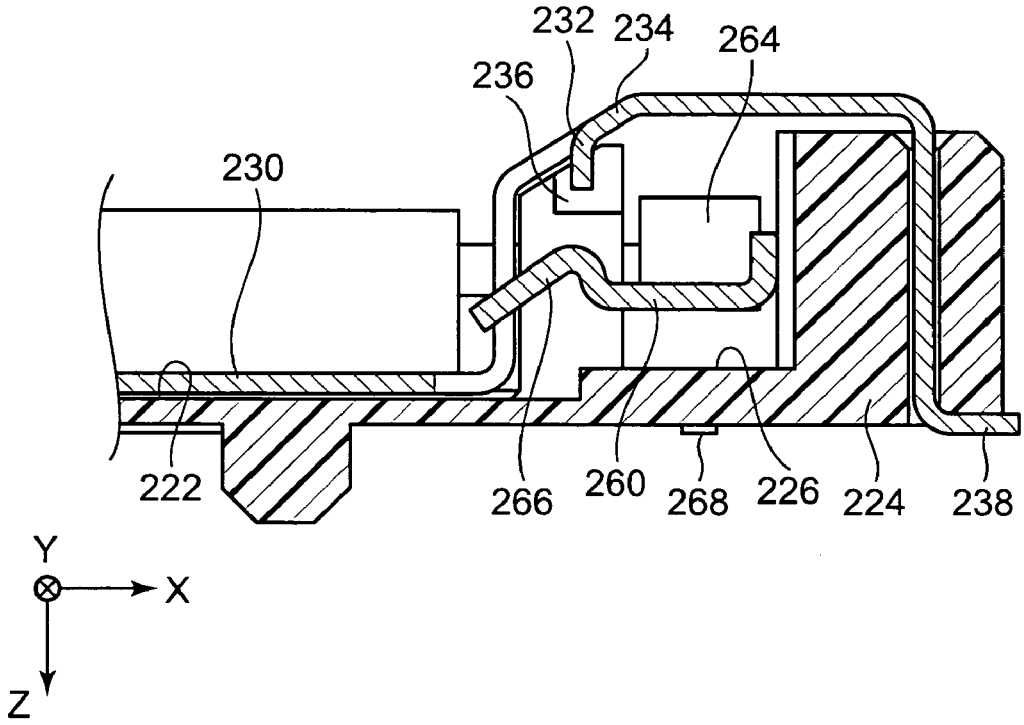
FIG. 5 is an enlarged cross-sectional view showing the receptacle connector of FIG. 3 taken along line V-V.

As shown in FIGS. 3 to 5, the receptacle connector 200 includes a plurality of contacts 210, an insulator (first insulator) 220 configured to hold the contacts 210, a shell 230 covering part of the insulator 220, and detection switches 240 incorporated in the insulator 220.

As shown in FIG. 4, the insulator 220 includes a receiving portion 222 defining a space to receive a matable portion of the plug connector 300 and side portions 224 provided so as to interpose the receiving portion 222 therebetween in the X-direction (activation direction). Each of the side portions 224 includes a switch holder 226 configured to hold the detection switch 240.

As shown in FIG. 4, the shell 230 is formed by punching and pressing a sheet metal. The shell includes lock operation portions 232 covering the switch holders 226. Each of the lock operation portions 232 includes a guide portion 234 having a surface extending in a direction that is oblique to both of the X-direction and the Z-direction. The lock operation portion 232 also has a hole 236 extending along the X-direction through the lock operation portion 232. Furthermore, the shell 230 includes a plurality of solder portions 238. The receptacle connector 200 is fixed to a substrate (not shown) by soldering those solder portions 238.

As shown in FIG. 4, each of the detection switches 240 includes a stationary member 250 held on the insulator 220 and a movable member 260. The detection switches 240 are set in an off-state under the normal conditions.

Specifically, the stationary member 250 includes a first contact portion 252 and a solder portion 254. The stationary member 250 is attached to a front wall 226*a* of the switch holder 226 so that the first contact portion 252 is fixed in place within the switch holder 226.

Meanwhile, the movable member 260 includes a second contact portion 262, a support portion 264, a push portion 266, and a solder portion 268. The support portion 264 is supported on a rear wall 226*b* of the switch holder 226 so that the second contact portion 262 is movable within the switch holder 226 along the Z-direction. The second contact portion 262 of the present embodiment is provided on a tip of a spring-like portion of the movable member 260, which extends along the negative Y-direction from the support portion 264. The second contact portion 262 is positioned so as to face the first contact portion 252 of the stationary member 250 in the Z-direction. The push portion 266 is located between the second contact portion 262 and the support portion 264 in the Y-direction. In the present embodiment, a primary portion of the movable member 260 extends along the negative Y-direction. Nevertheless, the present invention is not limited to this example. The movable member 260 may extend along another direction. From the viewpoint of demands for reduction in thickness of the connector assembly 100, it is preferable for a primary portion of the movable member 260 to extend along a direction perpendicular to the Z-direction.

As shown in FIGS. 4 and 5, the push portion 266 of the present embodiment extends in a direction that is oblique to both of the X-direction and the Z-direction under the state that the support portion 264 is supported on the rear wall 226*b* of the switch holder 226. Furthermore, as shown in FIG. 5, the push portion 266 extends toward the receiving portion 222 from below the guide portion 234 of the shell 230.

As described above, the push portion 266 of the present embodiment is located between the second contact portion 262 and the support portion 264. Therefore, the second contact portion 262 can be moved to a large extent by a slight movement of the push portion 266. Furthermore, since the push portion 266 extends in the direction that is oblique to both of the X-direction and the Z-direction, the second contact portion 262 of the movable member 260 can be moved in the Z-direction when a force is applied to the push portion 266 along either the X-direction or the Z-direction. When a force is applied to the push portion 266 such that the second contact portion 262 is moved and brought into contact with the first contact portion 252, electrical connection is established between the solder portion 268 of the of the movable member 260 and the solder portion 254 of the stationary member 250. In the present embodiment, conduction and non-conduction between these portions are used to detect a lock state, which will be described later.

Figure 6:
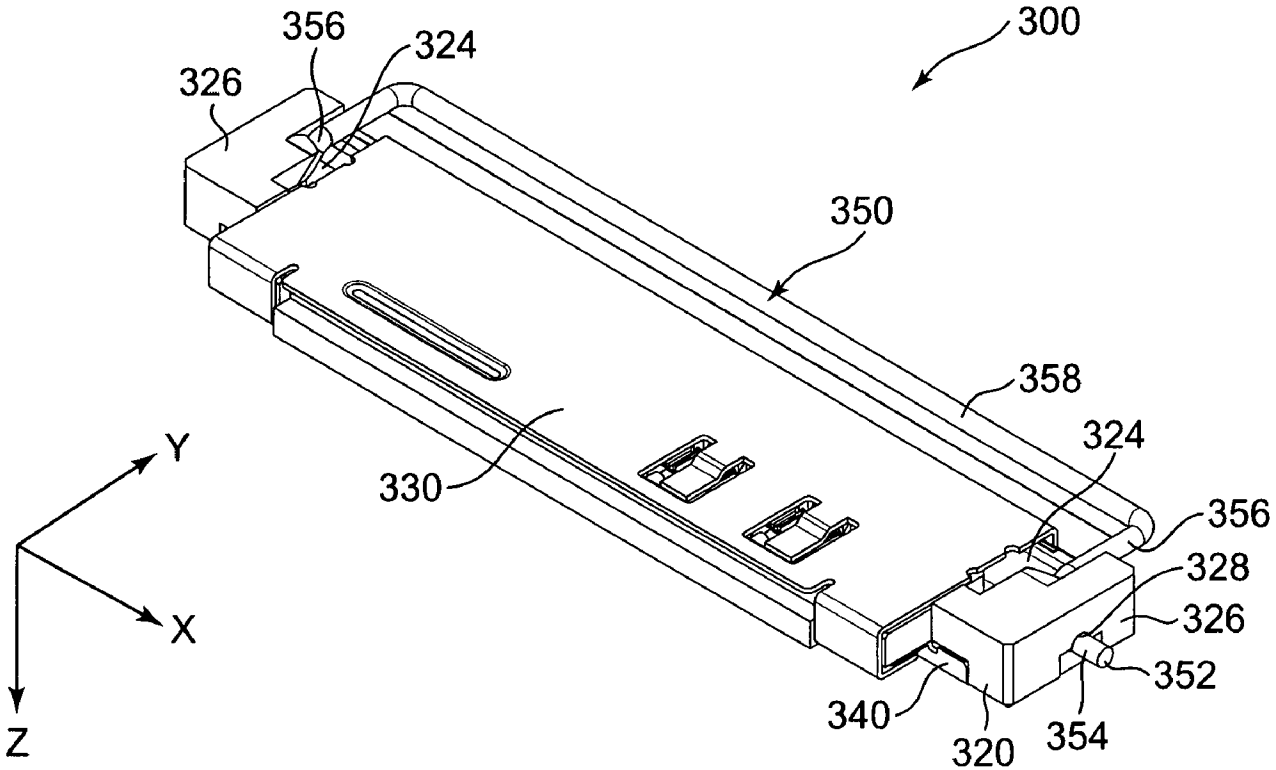
FIG. 6 is a perspective view showing the plug connector of FIG. 1.
Figure 7:
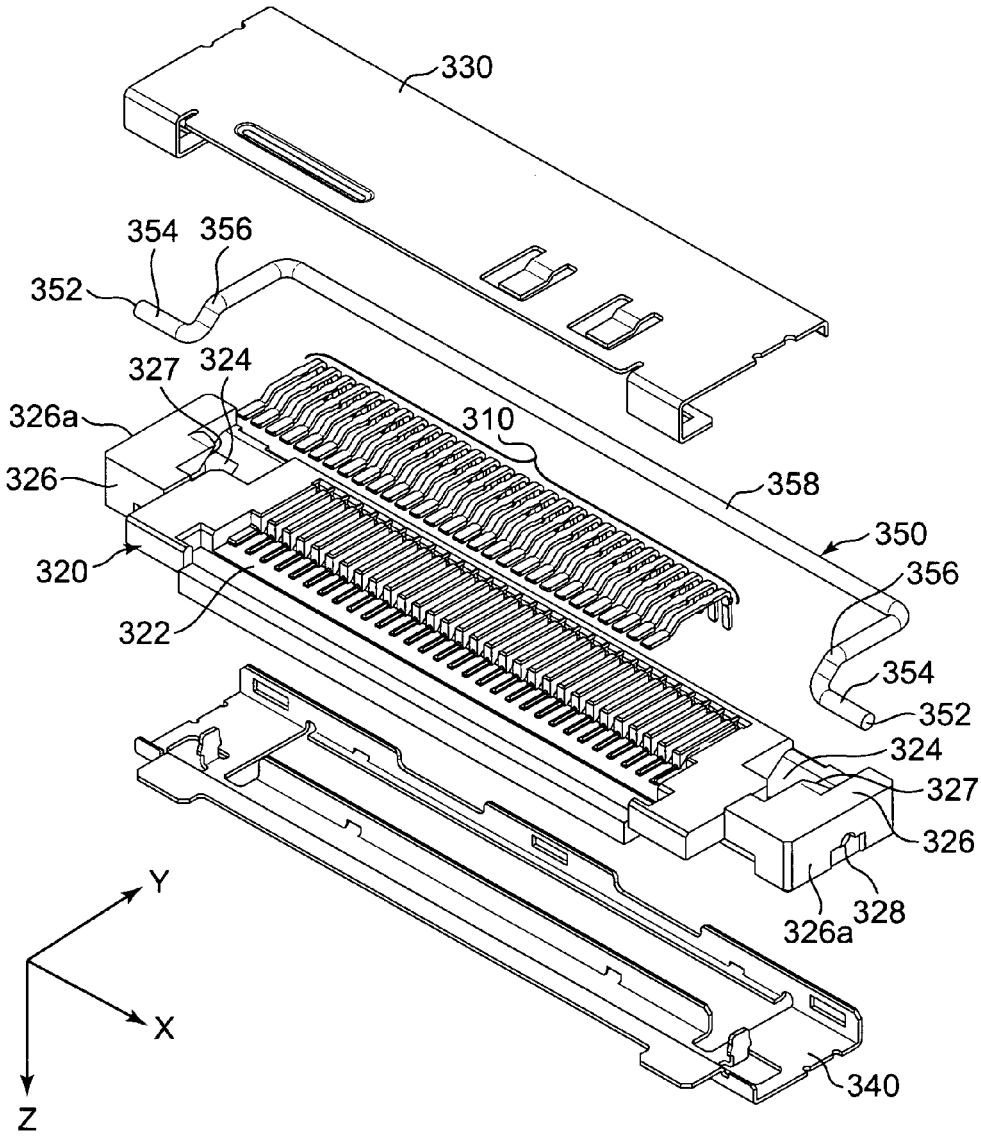
FIG. 7 is an exploded perspective view showing the plug connector of FIG. 6.

As shown in FIGS. 6 and 7, the plug connector 300 includes a plurality of contacts 310, an insulator (second insulator) 320 configured to hold the contacts 310, an upper shell 330 covering an upper portion of the insulator 320, a lower shell 340 covering a lower portion of the insulator 320, and a lock member 350 pivotally mounted to the insulator 320. The upper shell 330 and the lower shell 340 are formed of metal. The lock member 350 is formed by bending a metal rod made of deformable metal.

As shown in FIG. 7, the insulator 320 includes a base portion 322 configured to hold the contacts 310, receptacle portions 324 provided so as to interpose the base portion 322 therebetween in the X-direction, and retainer blocks 326 provided outside of the receptacle portions 324. Each of the retainer blocks 326 has a cam portion 327 formed on a surface near the receptacle portion 324. Furthermore, each of the retainer blocks 326 has a retainer hole 328 extending along the X-direction through the retainer block 326. In other words, the receptacle portion 324 communicates with an outer edge surface 326*a* of the retainer block 326 via the retainer hole 328 in the X-direction.

As shown in FIG. 7, the lock member 350 has lock activation portions 352 on opposite ends thereof. The lock member 350 also has retention portions 354 extending linearly, cam followers 356 extending from the retention portions 354, and a base portion 358 extending in parallel to the retention portions 354 from the cam followers 356. Each of the retention portions 354 is held in the retainer hole 328. Thus, the retention portions 354 are rotatable within the retainer holes 328, and the lock activation portions 352 located at tips of the retention portions 354 are movable along the X-direction. The lock activation portion 352 extends outward from the retainer block 326 under the state that the lock member 350 is laid under the normal conditions (see FIG. 6). Each of the cam followers 356 is partially received in the receptacle portion 324. When the base portion 358 is operated to raise the lock member 350, the cam followers 356 follow the cam portions 327 along with the operation of the base portion 358. As the cam followers 356 follow the cam portions 327, the lock activation portions 352 are moved along the X-direction toward the inner sides of the retainer blocks 326, respectively. In other words, upon pivotally raising the lock member 350, the retention portions 354 (the ends of the lock member 350) are forced inwardly by coaction of the cam followers 356 of the lock member 350 (see FIG. 7) with the cam portions 327 of the retainer blocks 326 to permit release of the plug connector 300 from the receptacle connector 200 (See FIG. 8).

Figure 8:
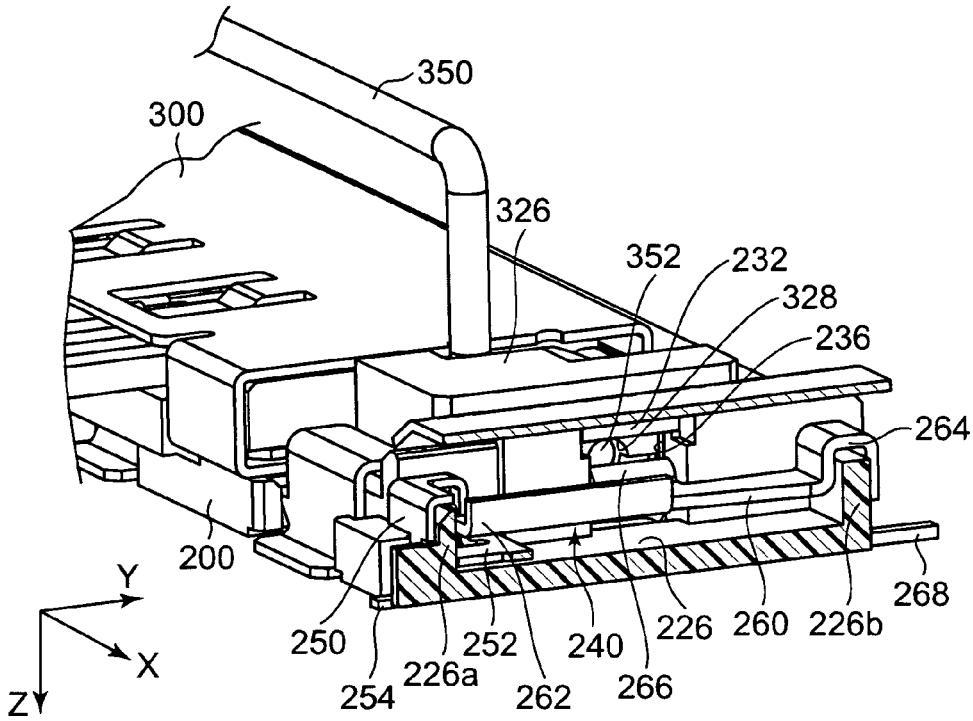
FIG. 8 is an enlarged perspective view showing the connector assembly of FIG. 1 with a cross-section taken along line VIII-VIII of FIG. 1. In the illustrated connector assembly, the mating state is not locked.

As shown in FIG. 8, if the plug connector 300 is mated with the receptacle connector 200 under the state that the lock activation portions 352 are received within the retainer holes 328, then the lock operation portions 232 do not prevent the lock activation portions 352 from moving in the negative Z-direction. Therefore, the plug connector 300 can be drawn and separated from the receptacle connector 200 in the negative Z-direction (separation direction). In other words, the mating state of the plug connector 300 with the receptacle connector 200 is not locked in the state shown in FIG. 8. The positions of the lock activation portions 352 at that time are referred to as unlock positions.

Figure 9:
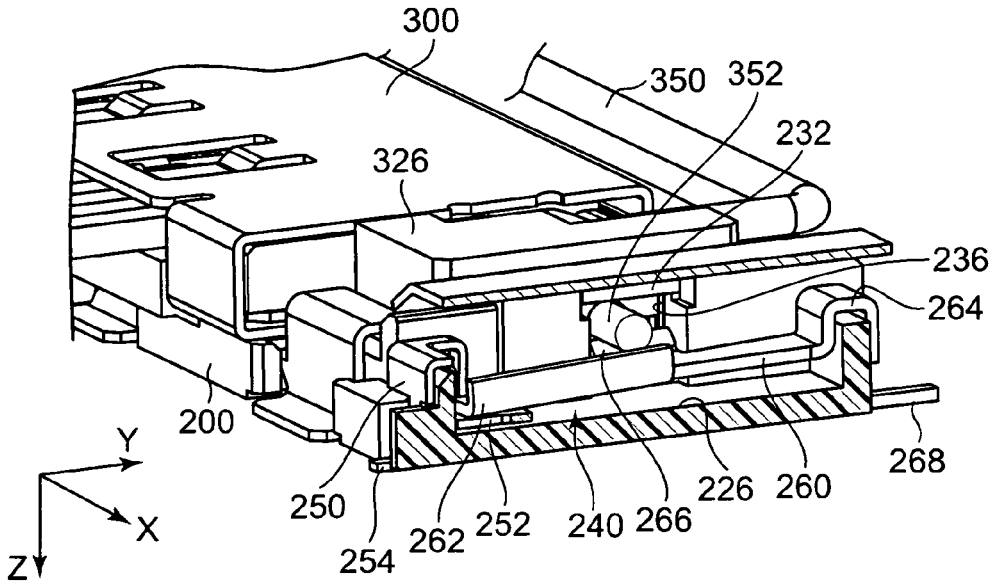
FIG. 9 is an enlarged perspective view showing the connector assembly of FIG. 1 with a cross-section taken along line IX-IX of FIG. 1. In the illustrated connector assembly, the mating state is locked.

On the other hand, as shown in FIG. 9, if the plug connector 300 is mated with the receptacle connector 200 under the state that the lock activation portions 352 are passed through the holes 236 of the lock operation portions 232 and located within the switch holders 226, then the lock operation portions 232 prevent the lock activation portions 352 from moving in the negative Z-direction. Accordingly, even if a force is applied in the negative Z-direction to the plug connector 300 so as to draw and separate the plug connector 300 from the receptacle connector 200, the plug connector 300 cannot be drawn or separated from the receptacle connector 200. Thus, the mating state of those connectors has been locked. The positions of the lock activation portions 352 at that time are referred to as lock positions.

Referring to FIG. 8, when the lock activation portions 352 are located at the unlock positions, they do not press the push portions 266. Therefore, the second contact portions 262 of the movable members 260 are not brought into contact with the first contact portions 252 of the stationary members 250. Accordingly, an open circuit is formed between the solder portions 254 of the stationary members 250 and the solder portions 268 of the movable members 260. On the other hand, referring to FIG. 9, when the lock activation portions 352 are located at the lock positions, they press the push portions 266 so as to move the second contact portions 262 of the movable members 260 and bring it into contact with the first contact portions 252 of the stationary members 250. Thus, a short circuit is formed between the solder portions 254 of the stationary members 250 and the solder portions 268 of the movable members 260. Therefore, the positions of the lock activation portions 352, i.e., whether the lock activation portions 352 are at the lock positions or the unlock positions, can be detected by monitoring an electric state between the solder portions 254 of the stationary members 250 and the solder portions 268 of the movable members 260.

The detection switches 240 of the present embodiment are turned on and off by the lock activation portions 352 and are formed integrally with the lock mechanisms including the lock activation portions 352 and the lock operation portions 232. Therefore, miniaturization can be achieved as compared to a case where a lock mechanism is provided separately from the detection switches 240. Furthermore, since the movable member 260 of each detection switch 240 extends in a direction perpendicular to the Z-direction, which is the mating direction, the detection switch 240 can be provided without rejecting demands for reduction of the thickness.

In the present embodiment, as shown in FIG. 5, the guide portions 234, which extend in directions that are oblique to both of the X-direction and the Z-direction, are provided on the receptacle connector 200. Therefore, when the plug connector 300 is to be mated with the receptacle connector 200 under the state that the lock activation portions 352 project outward from the retainer blocks 326, the lock activation portions 352 are momentarily moved toward the inner sides of the retainer blocks 326 by the guide portions 234 and then moved so as to spring out from the retainer blocks 326 into the holes 236. In other words, during insertion of the plug connector 300, the retention Portions 354 (the ends of the lock member 350) are deformed inwardly by engagement with the guide portions 234 of the receptacle connector 200 (see FIG. 5), after which the retention portions 354 snap outwardly to be received in holes 236 of the shell 230 of the receptacle connector 200 to retain the plug connector 300 to the receptacle connector 200 and to press on the push portions 266 to move the second contact portions 262 (movable switch parts) to close the detection switches 240 (see FIG. 9). Thus, according to the present embodiment, when the plug connector 300 is to be mated with the receptacle connector 200 under the state that the lock activation portions 352 project outward from the retainer blocks 326, the lock activation portions 352 do not inhibit the mating process of the plug connector 300 with the receptacle connector 200.

Although the present invention has been described with the specific embodiment, the present invention is not limited to the aforementioned embodiment.

For example, in the above embodiment, each of the first contact portions 252 is disposed so as to face the corresponding second contact portion 262 in the Z-direction. When the corresponding lock activation portion 352 is moved into the lock position, the second contact portion 262 is moved along the Z-direction into contact with the first contact portion 252. Nevertheless, the present invention is not limited to this example. For example, as shown in FIGS. 10 to 12, a second contact portion $\mathbf{262}_1$ may be provided so as to be movable in the X-direction.

Figure 10:
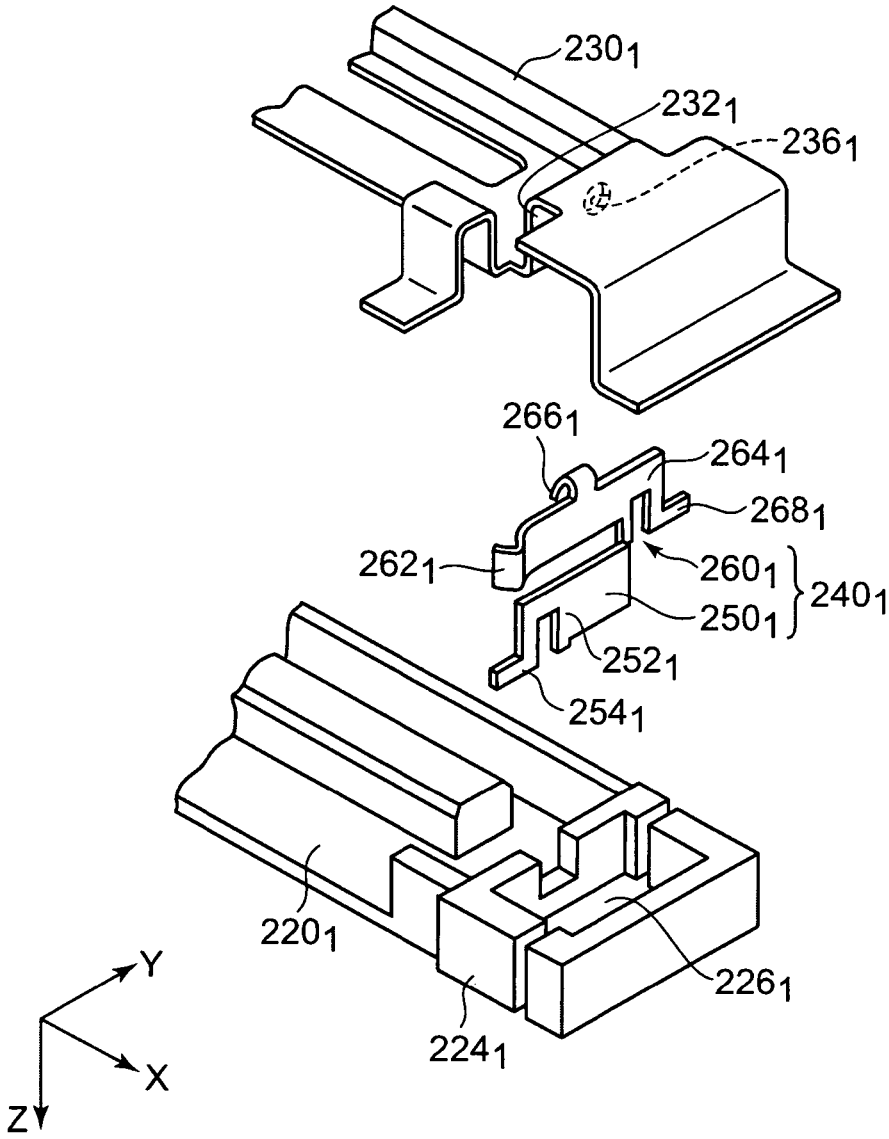
FIG. 10 is an exploded perspective view showing a variation of a detection switch.
Figure 11:
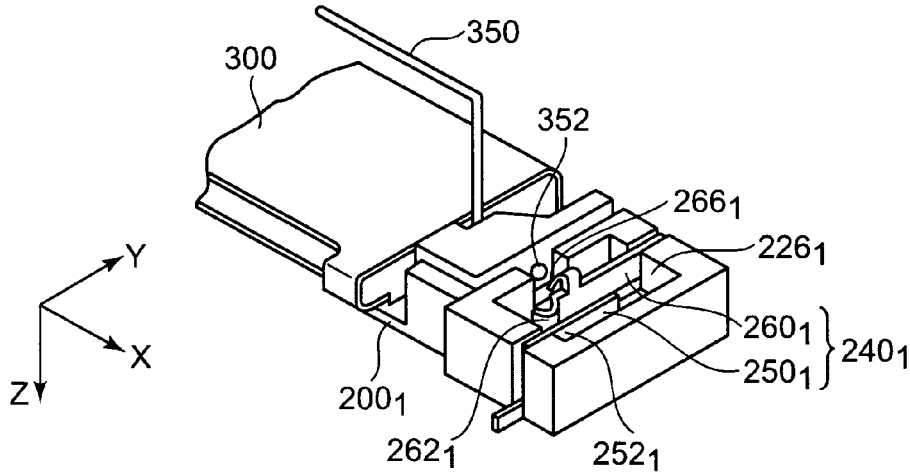
FIG. 11 is a perspective view showing the detection switch of FIG. 10 when the mating state is not locked.
Figure 12:
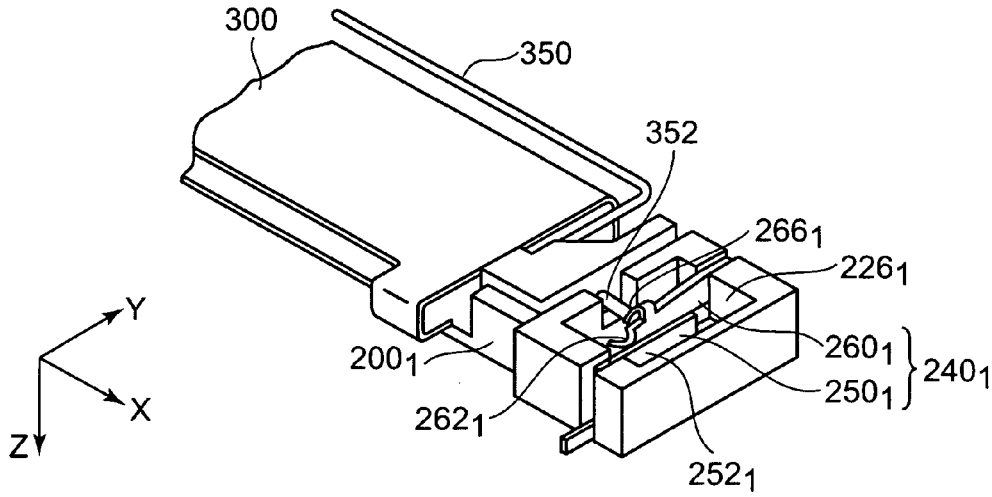
FIG. 12 is a perspective view showing the detection switch of FIG. 10 when the mating state is locked.

In the example illustrated in FIGS. 10 to 12, a hole $\mathbf{236}_1$ is formed in a lock operation portion $\mathbf{232}_1$ of a shell $\mathbf{230}_1$. The lock activation portion 352 of the lock member 350 can be inserted into the hole $\mathbf{236}_1$. A switch holder $\mathbf{226}_1$ is formed in a side portion $\mathbf{224}_1$ of an insulator $\mathbf{220}_1$. The switch holder $\mathbf{226}_1$ houses a detection switch $\mathbf{240}_1$, which includes a stationary member $\mathbf{250}_1$ and a movable member $\mathbf{260}_1$. Specifically, the stationary member $\mathbf{250}_1$ includes a first contact portion $\mathbf{252}_1$ and a solder portion $\mathbf{254}_1$. The stationary member $\mathbf{250}_1$ is held on the insulator $\mathbf{220}_1$ so that the first contact portion $\mathbf{252}_1$ is fixed in place within the switch holder $\mathbf{226}_1$. Meanwhile, the movable member $\mathbf{260}_1$ includes a second contact portion $\mathbf{262}_1$, a support portion $\mathbf{264}_1$, a push portion $\mathbf{266}_1$, and a solder portion $\mathbf{268}_1$. The movable member $\mathbf{260}_1$ is supported on the insulator $\mathbf{220}_1$ so that the second contact portion $\mathbf{262}_1$ is movable within the switch holder $\mathbf{226}_1$ along the X-direction. In FIGS. 11 and 12, the shell $\mathbf{230}_1$ is not illustrated for the sake of brevity.

When the lock member 350 is raised as shown in FIG. 11, the lock activation portion 352 does not press the push portion $\mathbf{266}_1$ of the movable member $\mathbf{260}_1$. In that state, the second contact portion $\mathbf{262}_1$ is not held in contact with the first contact portion $\mathbf{252}_1$. Therefore, an open circuit is formed between the solder portion $\mathbf{254}_1$ and the solder portion $\mathbf{268}_1$.

When the lock member 350 is pushed down (laid down) as shown in FIG. 12, the lock activation portion 352 is passed through the hole $\mathbf{236}_1$ and inserted in the switch holder $\mathbf{226}_1$. Then the lock activation portion 352 presses the push portion $\mathbf{266}_1$ in the X-direction so as to move the second contact portion $\mathbf{262}_1$ along the X-direction and bring it into contact with the first contact portion $\mathbf{252}_1$. The contact of the second contact portion $\mathbf{262}_1$ with the first contact portion $\mathbf{252}_1$ produces a short circuit between the solder portion $\mathbf{254}_1$ and the solder portion $\mathbf{268}_1$. Thus, in this example, the lock state of the lock activation portion 352 can be detected by detection of the short circuit between the solder portion $\mathbf{254}_1$ and the solder portion $\mathbf{268}_1$.

Furthermore, in the embodiment described in connection with FIGS. 1 to 9, each of the detection switches 240 includes two members of the stationary member 250 and the movable member 260. However, the present invention is not limited to that example. For example, as shown in FIGS. 13 to 15, the stationary member may be eliminated, and a portion of a shell $\mathbf{230}_2$ may have a function of the stationary member.

Figure 13:
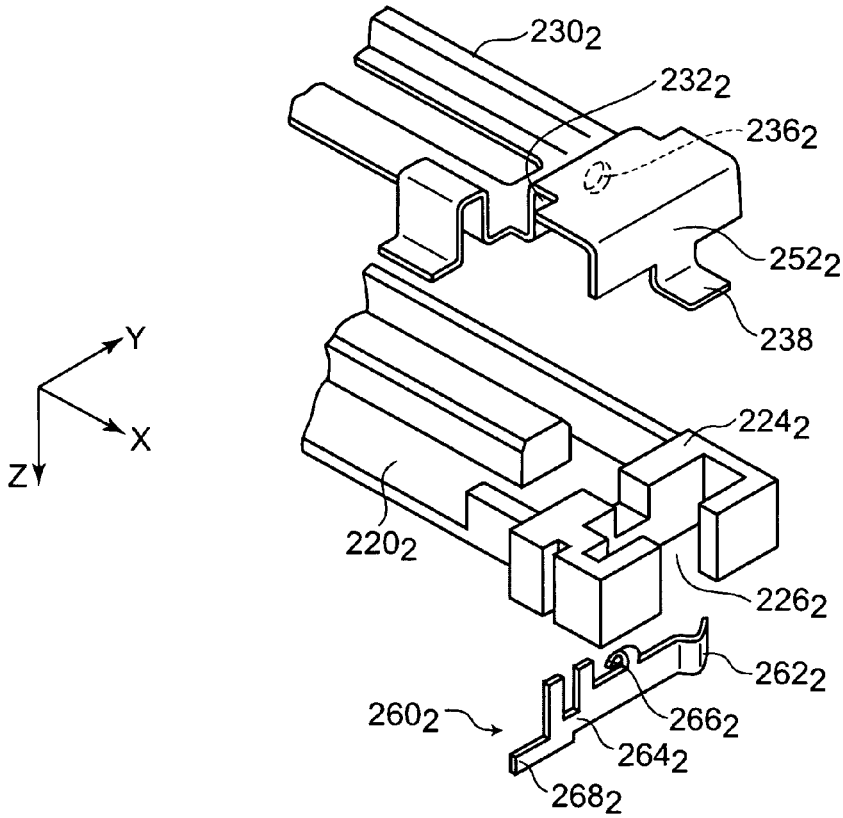
FIG. 13 is an exploded perspective view showing another variation of the detection switch.
Figure 14:
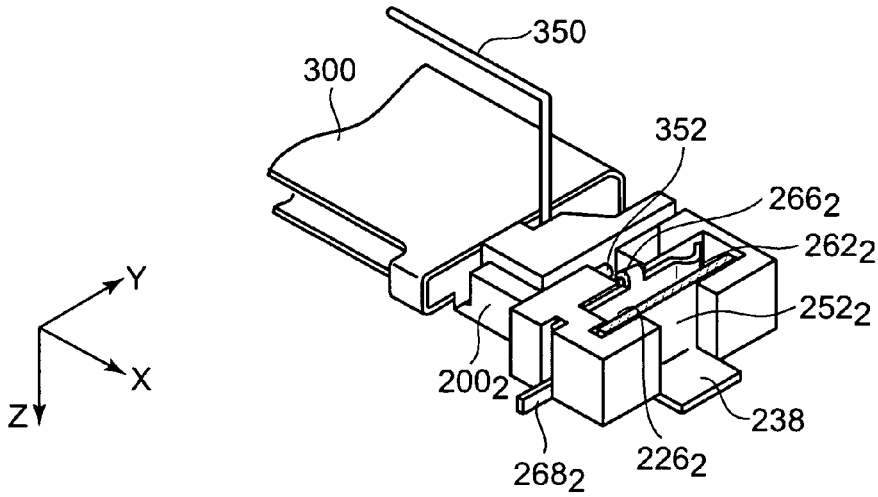
FIG. 14 is a perspective view showing the detection switch of FIG. 13 when the mating state is not locked.
Figure 15:
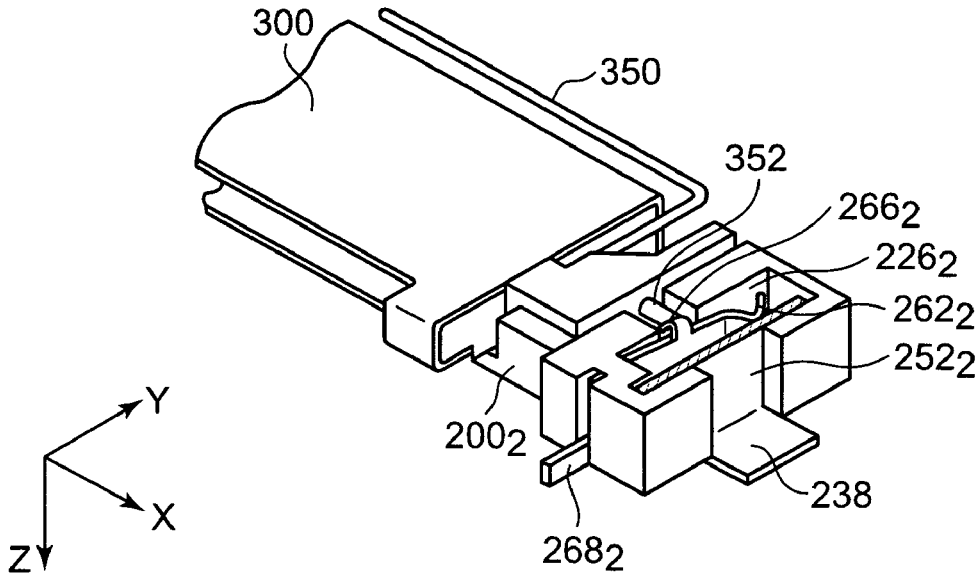
FIG. 15 is a perspective view showing the detection switch of FIG. 13 when the mating state is locked.

In the example illustrated in FIGS. 13 to 15, a hole $\mathbf{236}_2$ is formed in a lock operation portion $\mathbf{232}_2$ of the shell $\mathbf{230}_2$. The lock activation portion 352 of the lock member 350 can be inserted into the hole $\mathbf{236}_2$. A switch holder $\mathbf{226}_2$ is formed in a side portion $\mathbf{224}_2$ of an insulator $\mathbf{220}_2$. The switch holder $\mathbf{226}_2$ houses a detection switch, which is formed by a movable member $\mathbf{260}_2$ and a portion of the shell $\mathbf{230}_2$. A portion of the shell $230_2$ is fixed in place within the switch holder $226_2$ so as to serve as a first contact portion $252_2$. Meanwhile, the movable member $260_2$ includes a second contact portion $262_2$, a support portion $264_2$, a push portion $266_2$, and a solder portion $268_2$. The movable member $260_2$ is supported on the insulator $220_2$ so that the second contact portion $262_2$ is movable within the switch holder $226_2$ along the X-direction. In FIGS. 14 and 15, the shell $230_2$ and the portion serving as a stationary member are not illustrated for the sake of brevity.

When the lock member 350 is raised as shown in FIG. 14, the lock activation portion 352 does not press the push portion $266_2$. In that state, the second contact portion $262_2$ is not held in contact with the first contact portion $252_2$. Therefore, an open circuit is formed between the solder portion 238 and the solder portion $268_2$.

When the lock member 350 is pushed down (laid down) as shown in FIG. 15, the lock activation portion 352 is passed through the hole $236_2$ and inserted in the switch holder $226_2$. Then the lock activation portion 352 presses the push portion $266_2$ in the X-direction so as to move the second contact portion $262_2$ along the X-direction and bring it into contact with the first contact portion $252_2$. The contact of the second contact portion $262_2$ with the first contact portion $252_2$ produces a short circuit between the solder portion 238 and the solder portion $268_2$. Thus, in this example, the lock state of the lock activation portion 352 can be detected by detection of the short circuit between the solder portion 238 and the solder portion $268_2$.

Furthermore, in the above embodiment, the detection switches are set in an off-state under the normal conditions. However, the present invention is not limited to that example. For example, as shown in FIGS. 16 to 18, a detection switch $240_3$ may be set in an on-state under the normal conditions.

Figure 16:
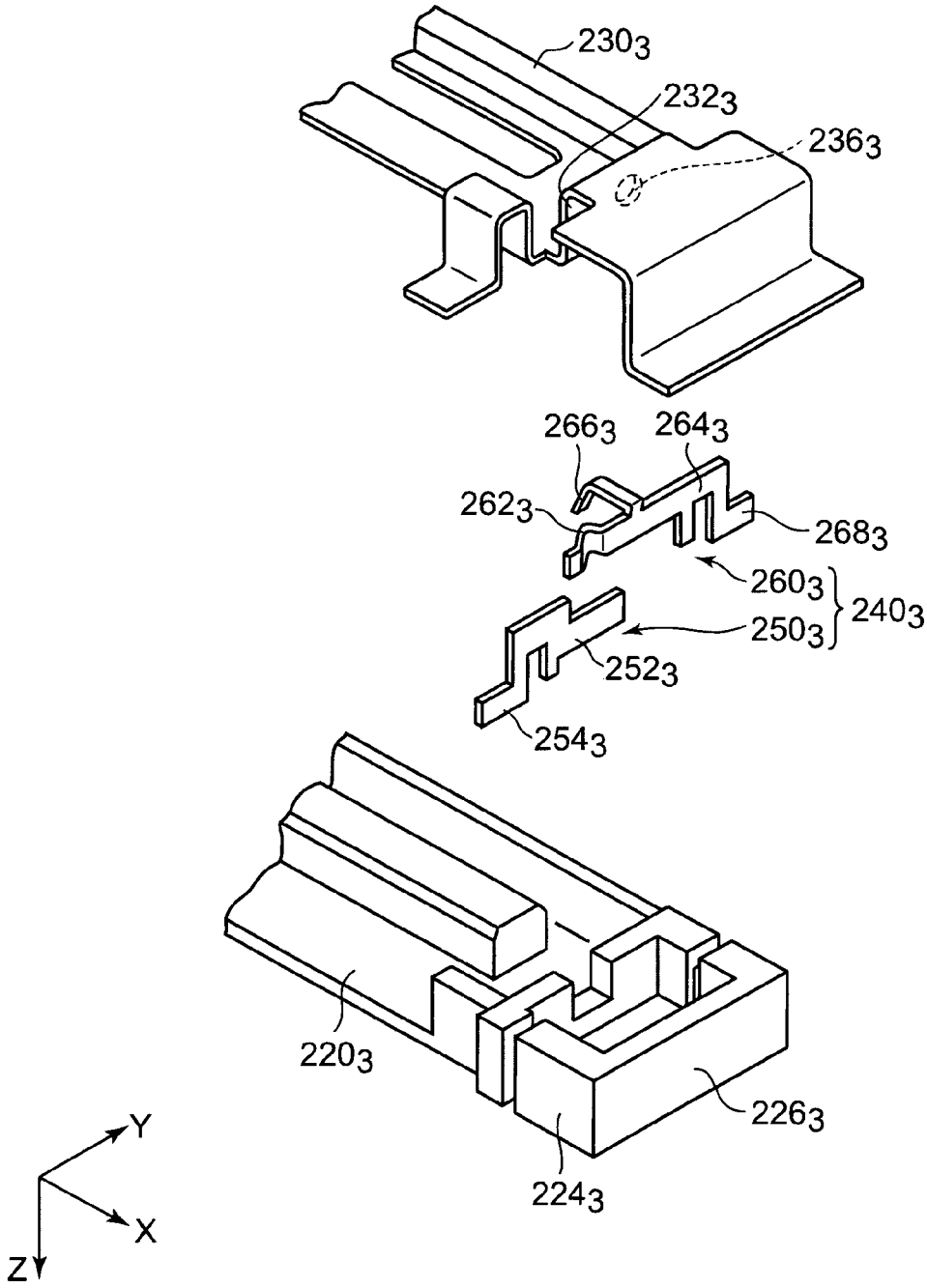
FIG. 16 is an exploded perspective view showing still another variation of the detection switch.
Figure 17:
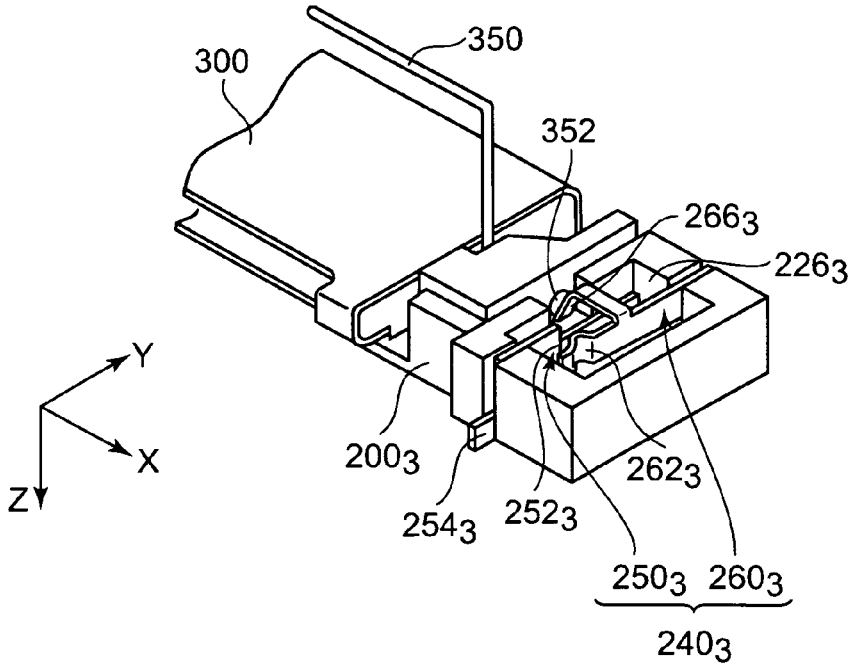
FIG. 17 is a perspective view showing the detection switch of FIG. 16 when the mating state is not locked.
Figure 18:
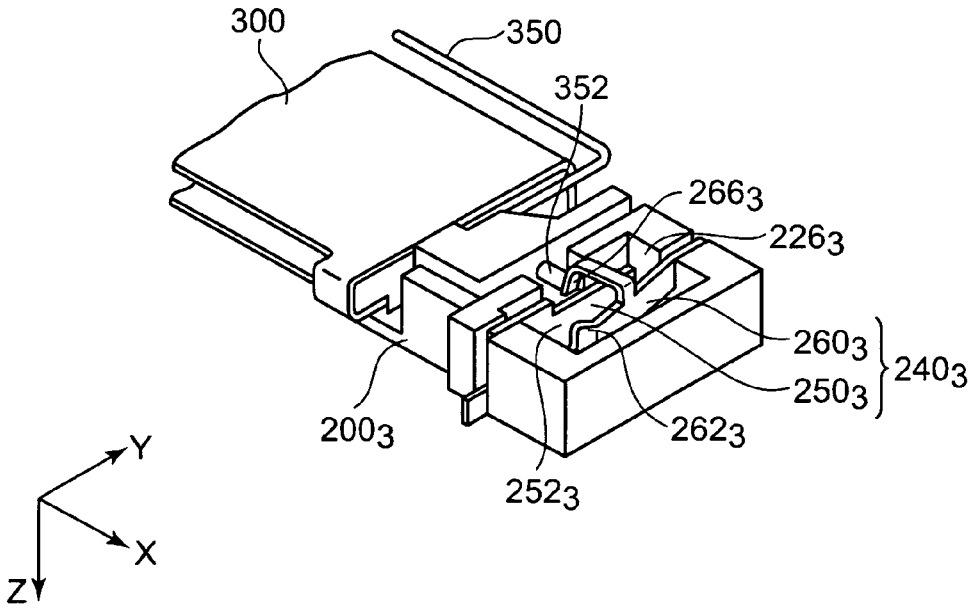
FIG. 18 is a perspective view showing the detection switch of FIG. 16 when the mating state is locked.

In the example illustrated in FIGS. 16 to 18, a hole $236_3$ is formed in a lock operation portion $232_3$ of a shell $230_3$. The lock activation portion 352 of the lock member 350 can be inserted into the hole $236_3$. A switch holder $226_3$ is formed in a side portion $224_3$ of an insulator $220_3$. The switch holder $226_3$ houses a detection switch $240_3$, which includes a stationary member $250_3$ and a movable member $260_3$. Specifically, the stationary member $250_3$ includes a first contact portion $252_3$ and a solder portion $254_3$. The stationary member $250_3$ is held on the insulator $220_3$ so that the first contact portion $252_3$ is fixed in place within the switch holder $226_3$. Meanwhile, the movable member $260_3$ includes a second contact portion $262_3$, a support portion $264_3$, a push portion $266_3$, and a solder portion $268_3$. The movable member $260_3$ is supported on the insulator $220_3$ so that the second contact portion $262_3$ is movable within the switch holder $226_3$ along the X-direction. In this example, the push portion $266_3$ extends so as to stride over the stationary member $250_3$. Portions of the movable member $260_3$ other than the push portion $266_3$ are located farther away from the lock activation portion 352 than the stationary member $250_3$ in the X-direction (see FIG. 18). In this regard, for example, the stationary member may be formed with a hole through which the lock activation portion 352 can pass. The push portion may be provided at a position to which the lock activation portion 352 can be moved through that hole; the position of the push portion enables the entire movable member to be located farther away from the lock activation portion than the stationary member. In FIGS. 17 and 18, the shell $230_3$ is not illustrated for the sake of brevity.

When the lock member 350 is raised as shown in FIG. 17, the lock activation portion 352 does not press the push portion $266_3$ of the movable member $260_3$. In that state, the second contact portion $262_3$ is held in contact with the first contact portion $252_3$. Therefore, a short circuit is formed between the solder portion $254_3$ and the solder portion $268_3$.

When the lock member 350 is pushed down (laid down) as shown in FIG. 18, the lock activation portion 352 is passed through the hole $236_3$ and inserted in the switch holder $226_3$. Then the lock activation portion 352 presses the push portion $266_3$ in the X-direction so as to move the second contact portion $262_3$ along the X-direction. Thus, the second contact portion $262_3$ is separated from the first contact portion $252_3$ and brought out of contact with the first contact portion $252_3$. Therefore, an open circuit is formed between the solder portion $254_3$ and the solder portion $268_3$ in the illustrated state. Thus, in this example, the lock state of the lock activation portion 352 can be detected by detection of the open circuit between the solder portion $254_3$ and the solder portion 26.

In the above embodiment, after the plug connector 300 is mated with the receptacle connector 200, the lock member 350 is rotated to move the lock activation portions 352 from the unlock positions to the lock positions. However, the plug connector 300 may be mated with the receptacle connector 300 under the state shown in FIG. 6, i.e., under the state that each of the lock activation portions 352 projects outward from the outer edge surface 326*a* of the retainer block 326 (the lock activation portions 352 are located at the lock positions). In this case, during the mating operation of the plug connector 300 with the receptacle connector 200, each of the lock activation portions 352 is guided by the guide portion 234, which elastically deforms the lock member 350 so that the lock activation portions 352 are momentarily withdrawn toward the inner sides of the retainer blocks 326 and then moved into the lock positions to spring out from the retainer blocks 326. Thus, the mating state of the plug connector 300 with the receptacle connector 200 is locked.

As described above, according to the present invention, when a lock activation portion, which can lock a mating state together with a lock operation portion, is located at a lock position, a detection switch is pressed by the lock activation portion. Therefore, the lock state can be detected with high reliability without increasing the size of the connector assembly.

Particularly, the detection switch includes two members including a stationary member and a movable member. The movable member is provided so as to extend in a direction perpendicular to the mating direction. Therefore, the detection switch can be provided without rejecting demands for reduction of the thickness of connectors.

The present application is based on a Japanese patent application of JP2009-037246 filed before the Japan Patent Office on Feb. 19, 2009, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector assembly comprising:

a first connector; and a second connector matable with the first connector along a mating direction, the second connector including a lock activation portion movable between a lock position and an unlock position along an activation direction perpendicular to the mating direction under a mating state of the first connector and the second connector, the first connector including a lock operation portion configured to ensure movement of the lock activation portion in a separation direction opposite to the mating direction when the lock activation portion is located at the unlock position under the mating state and to prevent movement of the lock activation portion in the separation direction so as to lock the mating state together with the lock activation portion of the second connector when the lock activation portion is located at the lock position, and a detection switch configured to be pressed by the lock activation portion located at the lock position under the mating state for detecting that the lock activation portion is located at the lock position, and a switch holder provided adjacent to the lock operation portion along the activation direction, wherein the detection switch is provided within the switch holder, and the lock activation portion presses the detection switch provided within the switch holder when the lock activation portion is located at the lock position, wherein the lock operation portion comprises a member having a hole extending therethrough along the activation direction, and wherein the lock activation portion presses the detection switch through the hole of the lock operation portion when the lock activation portion is located at the lock position.

2. The connector assembly as claimed in claim 1, wherein the first connector has a first insulator including the switch holder, and the second connector has a lock member including the lock activation portion and a second insulator configured to hold the lock member so that the lock activation portion is movable along the activation direction.

3. The connector assembly as claimed in claim 2, wherein the first insulator includes a shell configured to cover at least a portion of the first insulator, and the lock operation portion is formed as part of the shell.

4. The connector assembly as claimed in claim 2, wherein the detection switch has a stationary member including a first contact portion and a movable member including a second contact portion, the stationary member is held on the first insulator so that the first contact portion is fixed in place within the switch holder, and the movable member is held on the first insulator so that the second contact portion is movable within the switch holder when the movable member is pressed by the lock activation portion.

5. The connector assembly as claimed in claim 4, wherein the first contact portion and the second contact portion are separated from each other when the lock activation portion is at the unlock position, and are brought into contact with each other when the lock activation portion is at the lock position.

6. The connector assembly as claimed in claim 4, wherein the first contact portion and the second contact portion are brought into contact with each other when the lock activation portion is at the unlock position, and are separated from each other when the lock activation portion is at the lock position.

7. The connector assembly as claimed in claim 4, wherein the movable member is held on the first insulator so as to extend along a direction perpendicular to the mating direction.

8. The connector assembly as claimed in claim 7, wherein the second contact portion is movable along the mating direction.

9. The connector assembly as claimed in claim 7, wherein the second contact portion is movable along the activation direction.

10. The connector assembly as claimed in claim 4, wherein the movable member further includes a support portion supported by the first insulator and a push portion configured to be pressed by the lock activation, and the push portion is located between the support portion and the second contact portion.

11. The connector assembly as claimed in claim 10, wherein the push portion extends in a direction that is oblique to both of the mating direction and the activation direction.

12. The connector assembly as claimed in claim 1, wherein the first connector includes a guide portion having a surface that is oblique to both of the mating direction and the activation direction, the guide portion serving to guide the lock activation portion into the lock position when the second connector is mated with the first connector.

13. The connector assembly as claimed in claim 1, wherein the lock activation portion is made of metal.

14. A connector assembly comprising:

a first connector; and a second connector matable with the first connector along a mating direction, the second connector including a lock activation portion movable between a lock position and an unlock position along an activation direction perpendicular to the mating direction under a mating state of the first connector and the second connector, the first connector including a lock operation portion configured to ensure movement of the lock activation portion in a separation direction opposite to the mating direction when the lock activation portion is located at the unlock position under the mating state and to prevent movement of the lock activation portion in the separation direction so as to lock the mating state together with the lock activation portion of the second connector when the lock activation portion is located at the lock position, a detection switch configured to be pressed by the lock activation portion located at the lock position under the mating state for detecting that the lock activation portion is located at the lock position, a switch holder provided adjacent to the lock operation portion along the activation direction, wherein the detection switch is provided within the switch holder, and the lock activation portion presses the detection switch provided within the switch holder when the lock activation portion is located at the lock position, and a first insulator including the switch holder, and the second connector has a lock member including the lock activation portion and a second insulator configured to hold the lock member so that the lock activation portion is movable along the activation direction, the second insulator includes a retainer block having a cam portion and a retainer hole extending along the activation direction, the lock member is made of metal and provided with a retention portion including the lock activation portion at a tip thereof and being held in the retainer hole so as to be movable along the activation direction, a cam follower extending from the retention portion, and a base portion extending along the activation direction from the cam follower and being configured to press the cam follower to the cam portion when the base portion is operated, and when the base portion is operated, the cam follower follows the cam portion to move the lock activation portion from the lock position to the unlock position.

15. A connector assembly comprising:

a first connector; and a second connector matable with the first connector along a mating direction, the second connector including a lock activation portion movable between a lock position and an unlock position along an activation direction perpendicular to the mating direction under a mating state of the first connector and the second connector, the first connector including a lock operation portion configured to ensure movement of the lock activation portion in a separation direction opposite to the mating direction when the lock activation portion is located at the unlock position under the mating state and to prevent movement of the lock activation portion in the separation direction so as to lock the mating state together with the lock activation portion of the second connector when the lock activation portion is located at the lock position, a detection switch configured to be pressed by the lock activation portion located at the lock position under the mating state for detecting that the lock activation portion is located at the lock position, a switch holder provided adjacent to the lock operation portion along the activation direction, wherein the detection switch is provided within the switch holder, and the lock activation portion presses the detection switch provided within the switch holder when the lock activation portion is located at the lock position, and a first insulator including the switch holder, and the second connector has a lock member including the lock activation portion and a second insulator configured to hold the lock member so that the lock activation portion is movable along the activation direction, the first insulator has side portions located so as to interpose the second connector therebetween in the activation direction when the connector assembly is under the mating state, and the switch holder is formed within at least one of the side portions.

* * * * *